US005099903A

United States Patent [19]

Chen

[11] Patent Number: 5,099,903

[45] Date of Patent: Mar. 31, 1992

[54] FOLDABLE DOOR

[76] Inventor: Chang-Than Chen, No. 181, Po-Hai St., Kaohsiung, Taiwan

[21] Appl. No.: 672,029

[22] Filed: Mar. 19, 1991

[51] Int. Cl.[5] ..... E05D 15/26

[52] U.S. Cl. ..... 160/199; 160/206; 160/236

[58] Field of Search ..... 160/199, 206, 236, 213

[56] References Cited

U.S. PATENT DOCUMENTS

| | | | |
|---|---|---|---|
| 3,037,593 | 6/1962 | Webster | 160/236 X |
| 3,187,800 | 6/1965 | Kirby | 160/206 |
| 3,191,214 | 6/1965 | Protzman | 160/206 X |
| 3,221,804 | 12/1965 | Rudnick | 160/206 |
| 3,285,324 | 11/1966 | Stein et al. | 160/206 |
| 3,302,691 | 2/1967 | Andrews et al. | 160/206 |
| 3,391,723 | 7/1968 | Kirby | 160/206 |
| 3,511,300 | 5/1970 | Matyas | 160/206 |
| 3,866,658 | 2/1975 | Smith | 160/206 |
| 3,987,837 | 10/1976 | Hewson | 160/206 |

*Primary Examiner*—David M. Purol
*Attorney, Agent, or Firm*—Staas & Halsey

[57] ABSTRACT

A door includes two door panels pivotally coupled together so that the door panels are rotatable relative to each other. A roller is disposed on an upper end of two distal posts and is guided to slide along a guide rail. A cylinder is fixed on each end of one of the distal posts. A rod is fixed to the roller and extends through an upper cylinder. The lower portion of lower cylinder is rotatably received in a hole and can be easily disengaged from the hole when the distal post is pulled upward.

2 Claims, 4 Drawing Sheets

FOLDABLE DOOR

BACKGROUND OF THE INVENTION

1. Field of the Invention

The present invention relates to a foldable door, and more particularly to a foldable which can be easily detached.

2. Description of the Prior Art

The foldable doors which are available at present include a plurality of discs or rollers disposed on the upper portion of a plurality door panels and slidably received in a guide rail so that the door panels are collapsible or foldable. One side of one of the door panels is pivotally coupled to a frame. The foldable door can not be easily detached.

The present invention has arisen to mitigate and/or obviate the afore-described disadvantages of the conventional foldable doors.

SUMMARY OF THE INVENTION

The primary objective of the present invention is to provide a foldable door which can be easily assembled and disassembled.

In accordance with one aspect of the invention, there is provided a foldable door which includes two door panels pivotally coupled together so that the door panels are rotatable relative to each other. Each door panel includes a pair of posts provided on both sides. A roller is disposed on an upper end of two distal posts and is guided to slide along a guide rail so that the door panels can be folded up. A cylinder is fixed on an upper end and a lower end of one of the distal posts. A rod which is fixed to the roller extends through an upper cylinder so that the rod is rotatable relative to the upper cylinder. The lower portion of lower cylinder is rotatably received in a hole of a base so that the distal post is rotatable about an axis of the cylinders. The lower portion of the lower cylinder can be easily disengaged from the base when the distal post is pulled upward.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
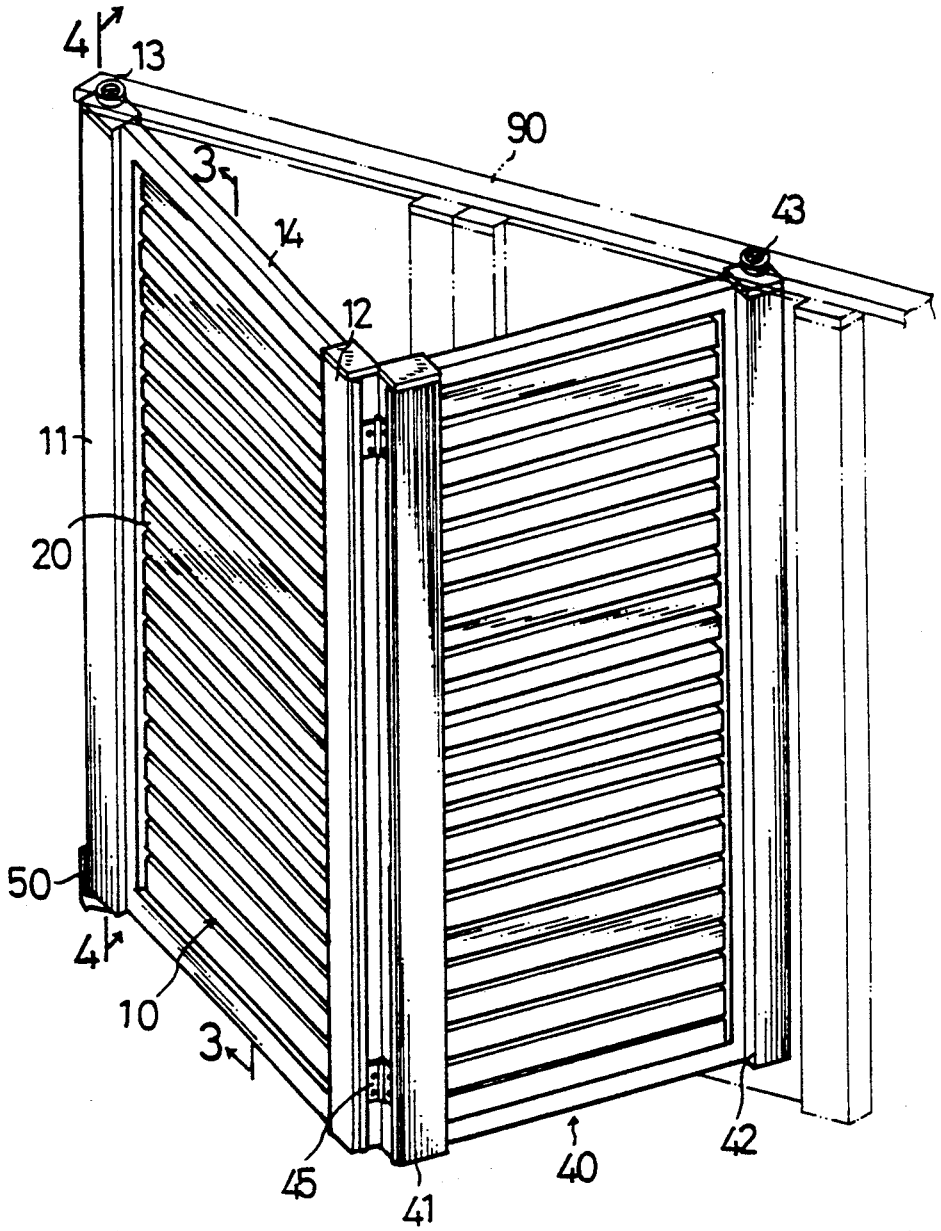
FIG. 1 is a partial perspective view of a foldable door in accordance with the present invention.

Referring to the drawings and initially to FIG. 1, a foldable door in accordance with the present invention comprises generally two door panels 10, 40 hinged or pivotally coupled together by hinges 45 so that the door panels 10, 40 are rotatable relative to each other about the hinges 45. Each of the door panels 10, 40 includes a pair of posts 11, 12, 41, 42 disposed on both sides thereof. Two beams 14 are fixed between the posts 11, 12 and are located on the upper end and the lower end of the door panel 10. A plurality of bars 20 form the body of the door panel 10. A roller 13, 43 is provided on the upper end of each of the two distal outer posts 11, 42 and is guided to slide along a guide rail 90 so that the door panels 10, 40 can be folded up. The lower end of the post 11 is pivotally coupled to a base 50 so that the axis of the post 11 becomes a rotational axis of the door panel 10.

Figure 2:
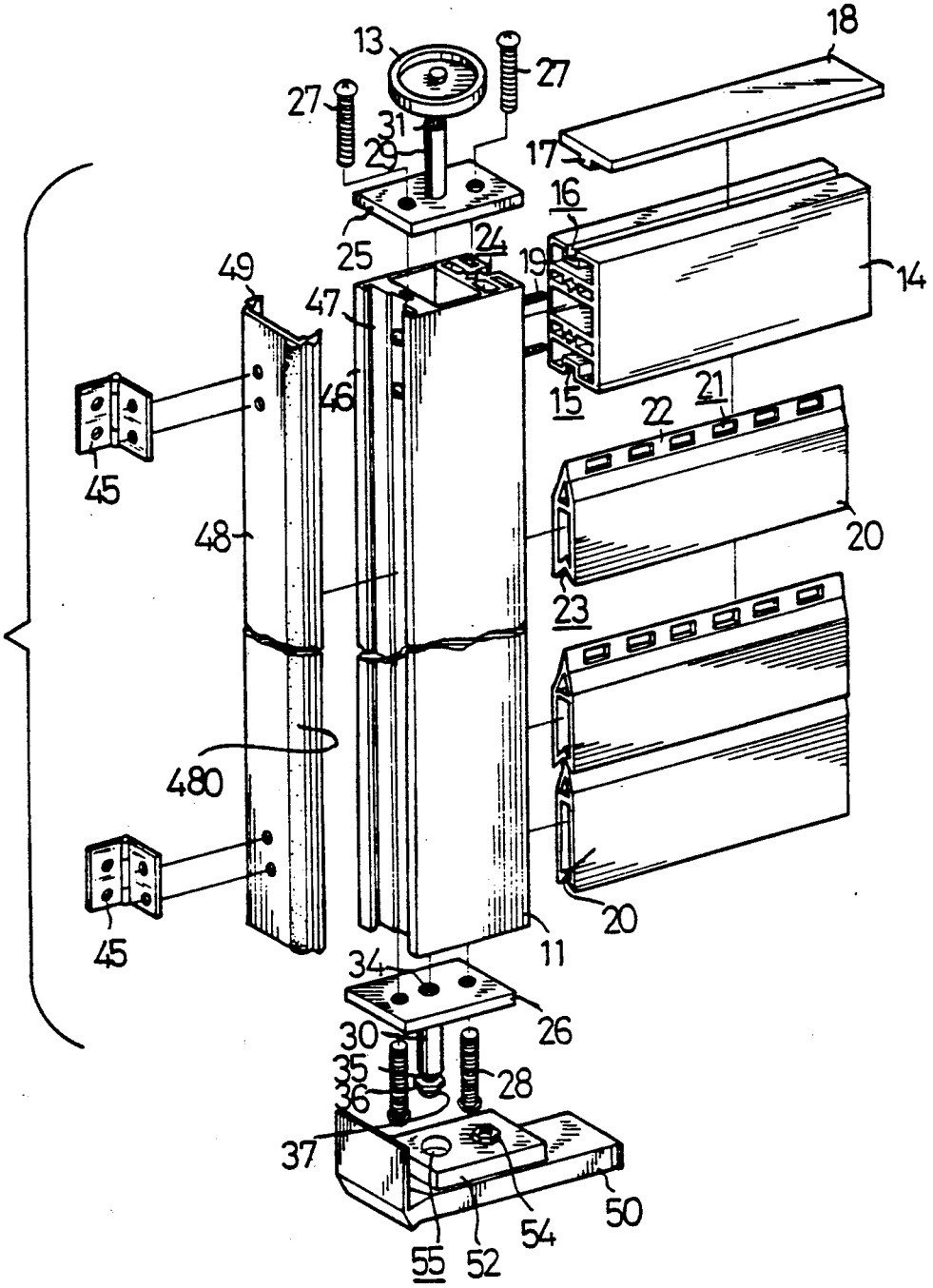
FIG. 2 is a partial exploded view of the foldable door.
Figure 3:
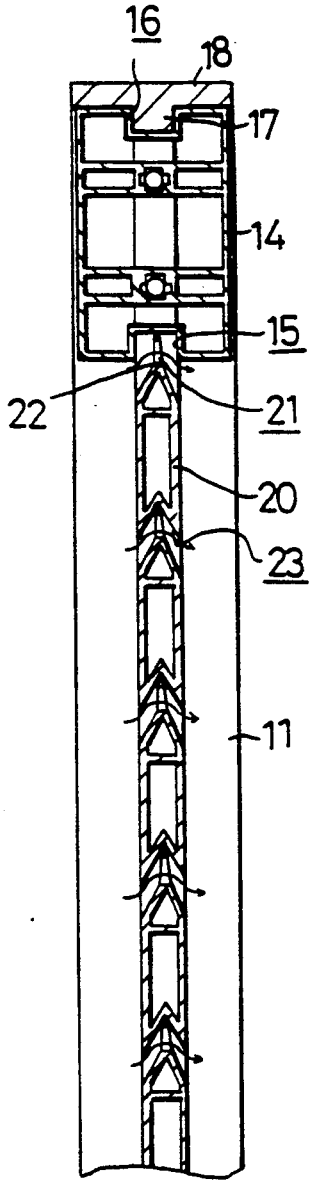
FIG. 3 is a cross sectional view taken along lines 3—3 of FIG. 1.

Referring next to FIGS. 2 and 3, the beams 14 are fixed to the post 11, 12 by bolts 19. A groove 15, 16 is formed in the upper surface and the lower surface of the beam 14 respectively. A rib 17 of a cover 18 is received in the groove 16 of the beam 14. Each of the bars 20 has a plurality of openings 21 formed in a tapered upper edge 22 thereof and has a recess 23 formed in the lower edge thereof. The tapered upper edge 22 of the bar 20 is received in either the groove 15 of the beam 14 or the recess 23 of the other bar 20. A channel 24 is formed in the inner surface of the post 11 for receiving the side edges of the bars 20 so that the bars 20 can be retained in place. The openings 21 are provided so that air may flow through the door panels 10, 40. It is to be noted that the openings 21 are preferably located within the groove 15 and the recesses 23 so that dust and the like can not flow through the openings 21 easily.

Referring next to FIG. 4 and again to FIG. 2, a plate 25, 26 is fixed to the upper end and the lower end of the post 11 respectively by bolts 27, 28. A cylindrical member 29, 30 is integrally fixed to each of the plates 25, 26 and extends away from the post 11. A rod 31 which has an upper end integrally fixed to the roller 13 extends through the cylindrical member 29. The lower end of the rod 31 is riveted. A shoulder 32 is formed in the cylindrical member 29. A spring 33 which is provided around the rod 31 has an upper end fixed to the rod 31 and has a lower end supported on the shoulder 32 so that the cylindrical member 29 and the post 11 can be biased downward relatively by the spring 33. A screw thread 34 is formed in the inner peripheral of the cylindrical member 30 for threadedly engaging a bolt 35. A disc 37 is formed on the lower end of the bolt head 36 of the bolt 35.

Figure 4:
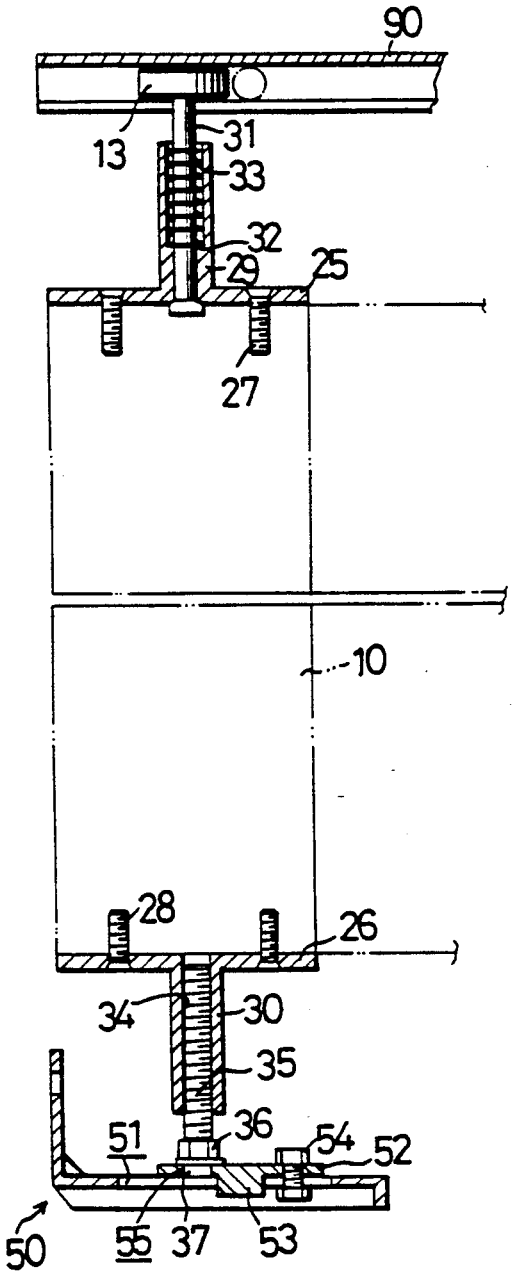
FIG. 4 is a partial cross sectional view taken along lines 4—4 of FIG. 1.

An oblong hole 51 is formed along the longitudinal axis of the base 50 (FIG. 4). A protrusion 53 is integrally formed on the lower surface of the board 52 and is slidably received in the oblong hole 51 of the base 50 so that the board 52 can be guided to slide along the oblong hole 51. A bolt and nut 54 fix the board 52 to the base 50. A hole 55 is formed in the board 52 for receiving the disc 37 of the bolt 35. The bolt 35 can be threaded relative to the cylindrical member 30 so that the height of the door leaf 10 can be adjusted. When the door panel 10 is raised against the bias of the spring 33, the disc 37 can be easily disengaged from the hole 55 so that the door panels can be easily assembled and disassembled.

The cylindrical members 29, 30 are rotatable about the rod 31 and the hole 55 respectively so that the post 11 is rotatable about the axis of the cylindrical members 29, 30. It is to be noted that, without the spring 33, the door panel 10 can also be forced downward by gravity.

Referring again to FIG. 2, a pair of flanges 46 are formed on the outer surface of the post 11 so that a guide channel 47 is formed therebetween. A pair of shoulders 49 are formed on the side edges of a filler element 48 and are engaged in the guide channel 47. The hinges 45 are fixed to the outer surface of the filler element 48. A rib 480 is formed on the outer surface of the filler element 48. The height of the rib 480 is determined according to the gap formed between the door panels 10, 40 so that the gap can be completely covered by the filler element 48.

Accordingly, the foldable door in accordance with the present invention can be easily assembled and disassembled. Air may flow through the openings 21 of the bars 20. The gap formed between every two adjacent door panels can be covered by the filler elements 48.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable door comprising:

at least two door panels pivotally coupled together so that said door panels are rotatable relative to each other, each of said door panels including a pair of posts provided on both sides thereof, in which two of said posts are adjacent and the other two are distal, a roller being disposed on an upper end of each of said two distal posts and being guided to slide along a guide rail so that said door panels can be folded up, a first cylindrical member and a second cylindrical member being respectively fixed on an upper end and a lower end of a first distal post respectively, a rod being fixed to said roller and extending through said first cylindrical member, said rod being rotatable relative to said first cylindrical member, a first bolt being threadedly engaged in said second cylindrical member, a lower portion of said first bolt having a circular cross section, a base; and a circular hole being formed in said base which is provided under said lower end of said first distal post, said lower portion of said first bolt being rotably recieved in said circular hole of said base so that said first distal post is rotable about an axis of said first cylindrical member and said second cylindrical member, and said lower portion of said first bolt can be easily disengaged from said base when said first distal post is pulled upward, each of said door panels including:

a pair of beams fixed on an upper portion and a lower portion thereof respectively, a channel formed in an innner surface of each of said posts, a groove formed in a lower surface of an upper beam, a plurality of bars disposed in a middle portion of each of said door panels and having end portions received in said channels of said posts, a recess formed in a lower surface of each of said bars, and a plurality of openings formed in a tapered portion which is formed on an upper edge of each of said bars and which is received in a respective recess of said bars, said tapered portion of an uppermost bar being received in said groove of said upper beam, air may flow through said openings which are located within said groove and said recesses so that dust can not flow through said openings easily.

2. A foldable door comprising:

at least two door panels pivotally coupled together so that said door panels are rotatable relative to each other, each of said door panels including a pair of posts provided on both sides thereof, in which two of said posts are adjacent and the other two are distal, said two adjacent posts having two adjacent surfaces facing each other, a pair of flanges formed on each of said adjacent surfaces so that a guide channel is formed between each pair of said flanges, a filler element for being received within said guide channel, and a rib formed on each of said filler element so that a gap formed between said two adjacent posts can be filled by said ribs of said filler element, a roller being disposed on an upper end of each of said two distal posts and being guided to slide along a guide rail so that said door panels can be folded up, a first cylindrical member and a second cylindrical member being fixed on an upper end and a lower end of a first distal post respectively, a rod being fixed to said roller and extending through said first cylindrical member, said rod being rotatable relative to said first cylindrical member, a first bolt being threadedly engaged in said second cylindrical member, a base; and a lower portion of said first bolt having a circular cross section, a circular hole being formed in said base which is provided under said lower end of said first distal post, said lower portion of said first bolt being rotatably received in said circular hole of said base so that said first distal post is rotatable about an axis of said first cylindrical member and said second cylindrical member, and said lower portion of said first bolt can be easily disengaged from said base when said first distal post is pulled upward.

* * * * *